US006137389A

United States Patent [19]

Uchikoba

[11] Patent Number: 6,137,389

[45] **Date of Patent: *Oct. 24, 2000**

[54] INDUCTOR ELEMENT FOR NOISE SUPPRESSION

[75] Inventor: Fumio Uchikoba, Chiba, Japan

[73] Assignee: TDK Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/712,646

[22] Filed: Sep. 11, 1996

[30] Foreign Application Priority Data

Sep. 12, 1995 [JP] Japan ..... 7-234420

[51] Int. Cl.[7] ..... H01F 27/24; H01F 27/30

[52] U.S. Cl. ..... 336/83; 333/185; 336/175; 336/192; 336/233

[58] Field of Search ..... 336/83, 192, 176, 336/175, 233; 333/12, 81 R, 185

[56] References Cited

U.S. PATENT DOCUMENTS

| | | | |
|---|---|---|---|
| 4,146,854 | 3/1979 | Ishino et al. . | |
| 4,297,661 | 10/1981 | Stegens . | |
| 4,301,428 | 11/1981 | Mayer . | |
| 4,776,980 | 10/1988 | Ruffini | 336/233 |
| 5,359,311 | 10/1994 | Kawabata et al. | 336/83 |

FOREIGN PATENT DOCUMENTS

| | | | |
|---|---|---|---|
| 4-127701 | 4/1992 | Japan . | |
| 4-239107 | 8/1992 | Japan | 336/192 |
| 8-78218 | 3/1996 | Japan . | |
| 8-204486 | 8/1996 | Japan . | |

OTHER PUBLICATIONS

"A Dissipative Coaxial RFI Filter," Paul Schiffres. IEEE Transactions on Electromagnetic Compatibility; Jan. 1964 p. 55–61.

"Compatible EMI Filters," H. M. Schlicke, et al. IEEE Spectrum; Oct. 1967 p. 59–68.

"Miniature Low–Pass EMI Filters," Jerry H. Bogar, et al. Proceedings of the IEEE, vol. 67, No. 1, Jan. 1979 p. 159–163.

"Transmission Properties of Metal–Semiconductor–Relaxor Microstrip Lines," Hector H. Fiallo, et al. IEEE Transactions on Microwave Theory and Techniques, vol. 42, No. 7, Jul. 1994 p. 1176–1182.

"Absorber Chip Provides RF EMI Filtering," F. Uchikoba, et al. Microwaves & RF; Feb. 1995 p. 69, 72.

*Primary Examiner*—Thomas J. Kozma

*Attorney, Agent, or Firm*—Oblon, Spivak, McClelland, Maier & Neustadt, P.C.

[57] ABSTRACT

The present invention is directed to an inductor element for noise suppression capable of suppressing the high frequency component in the GHz band through absorption.

A core for passing through a signal line conductor is provided. The core is at least partially constituted with a compound member that is prepared by mixing ferromagnetic metal particles and resin. The compound member imparts a frequency-dependant absorption loss to a signal running through the signal line conductor. The absorption loss starts essentially in the GHz band and the high level of absorption remains in effect up to at least 20 GHz.

13 Claims, 6 Drawing Sheets

INDUCTOR ELEMENT FOR NOISE SUPPRESSION

BACKGROUND OF THE INVENTION

1. Field of the Invention

The present invention relates to an inductor element for noise suppression that is used as an electronic circuit component and, in particular, it relates to an inductor element that imparts a noise suppressing effect in the GHz band.

2. Discussion of Background

Of the noise that enters an electronic circuit or is generated in an electronic circuit, in many cases a problem is presented by the component that is of a higher frequency than the signal frequency, and the normal countermeasures taken against such noise are intended to remove this component. A low pass filter or an electronic circuit with a similar effect is widely used for that purpose. These take advantage of the frequency dependency of impedance matching or mis-matching and on the high frequency side, filter characteristics are achieved by reflecting the signal. However, in such a case, the unnecessary high frequency component is returned to a preceding stage and this may result in, for instance, unexpected oscillation or the like in the circuit. In principle, therefore, it is desirable to remove such unnecessary frequency components through absorption.

Low pass type elements in the prior art that take advantage of absorption include ferrite bead elements. A ferrite bead element is an inductor element that uses ferrite for its core. As with normal inductor elements, the impedance increases as the frequency becomes higher and, at a specific frequency, the loss imparted by the ferrite material used for the core becomes pronounced. By matching the frequency of the noise to be removed with the frequency of the loss in the core, noise suppression through absorption is achieved.

However, the loss of ferrite occurs in the MHz band or, at the highest, at a few GHz, although this varies depending upon the composition of the ferrite, and if an inductor element is constituted with ferrite, effective noise suppression cannot be achieved in the GHz band.

U.S. Pat. No. 4,297,661 discloses a high pass filter that is constituted by employing a microstrip structure with ferrite. This high pass filter takes advantage of a phenomenon in which the absorption that occurs on the low range side disappears on the high range side.

Schiffres (IEEE Trans. Electron. Magn. Compot. EMC-6 1964, pages 55 to 61) sets out an example of an element using ferrite in the form of a coaxial transfer line, but this example aims at acquisition of characteristics mainly in the MHz band and does not disclose transmission characteristics in the high frequency range at or above the GHz band. It is assumed that similar transmission takes place in the GHz band.

In either of the prior art technologies described above, it is difficult to obtain a noise suppressing element capable of noise suppression in the GHz band by using ferrite only and combining ferrite with other materials has been suggested. As an example of such a combination, an attempt for noise suppression in the high frequency side through the combination of a non-magnetic material with absorption on the high range side with a ferrite has been reported.

This example was featured in the art by Schlicke (IEEE Spectrum 1967, pages 59 to 68) and the art disclosed by Bogar (Proc. of IEEE 67 1979, pages 159 to 163). In these technologies, a structure in which a ferrite and a dielectric body are provided coaxially at a portion of an insulator is employed. In addition, the art disclosed by Fiallo (IEEE Transactions of Microwave Theory and Techniques 1994, pages 1176 to 1184) reports on a microstrip structure in which a ferrite and a dielectric body are combined.

However, the elements disclosed in the prior art publications mentioned above, have complicated shapes, and they cannot be inserted in a circuit as easily as ferrite beads. In particular, while ferrite beads do not require grounding, the elements disclosed in the prior art publications require electrical grounding as well as signal lines.

The inventors of the present invention noted that a compound material that is achieved by combining ferromagnetic metal particles and resin imparts an electric wave absorbing effect in the GHz band. Examples of noise suppression that employ a magnetic metal particles- resin compound material are described below, although no disclosure of an inductor element for noise suppression in the GHz band, as in the present invention, is set forth in these examples.

For instance, in U.S. Pat. No. 4,146,854, an attenuating element is constituted with ferrite beads in combination with an electric wave absorbing body (a metal-resin compound material). In addition, in Japanese Unexamined Patent Publication (KOKAI) No. 127701/1992, an electric wave absorbing material is employed in a portion of a non-magnetic microstrip line. These two technologies feature an electric wave absorbing body used in a secondary capacity to suppress the excess high frequency component which could not otherwise be absorbed.

U.S. Pat. No. 4, 301, 428 discloses a technology for suppressing high frequency noise by using a metal-resin compound material with a suitable resistance value for a coaxial line and a signal line of a balanced line, and using a metal-resin compound material with an insulating property for a covering member. However, if a signal line is made to have an electrical resistance value, attenuation of the signal components will occur as well as suppression of the noise component and, therefore, this poses a problem when handling a weak signal. In addition, this example of prior art discloses a technology for electric cables and does not include instances in which the technology is employed in a circuit element.

At the same time, compound materials constituted of ferrite and resin are widely used as electric wave absorbing bodies. They are employed in these cases mainly for the purpose of absorbing electric waves radiated in the air and, therefore, the object is different from that of the present invention, which employs such a material for a circuit element.

In addition, compound materials constituted with iron particles and resin have been in use as a core material in a coil, i.e., the so-called dust core, for a long time. In this case, it is desirable to minimize the absorption loss since the material is used to constitute an inductor element in a circuit, and therefore, the attitude is just the contrary of that in the present invention, which actively takes advantage of the loss of the material.

Furthermore, in Japanese Patent Application No. 209586/1994 and Japanese Patent Application No. 9333/1995, and the publication in Microwaves & RF, February 1995, pages 69 to 72, the inventors of the present invention have disclosed a noise suppressing element for the GHz band employing a material similar to that in the present invention. What characterizes this element is that a grounding electrode is provided as well as a signal line to constitute a type of transmission path so that the characteristic impedance of the element can be matched with the characteristic impedance of the circuit from the passing band through the blocking range. It aims to minimize the reflection to absorb efficiently in the blocking range.

In this case, the full effect is realized when the impedance of the circuit to which the invention is applied is constant and there is a stable grounding pattern in the vicinity. However, if the characteristic impedance of the circuit is unstable due to a circuit-related reason or there is no grounding pattern nearby, it is difficult to take advantage of its noise suppression feature.

As has been explained, ferrite beads achieve simple and advantageous noise suppressing elements that do not require grounding, but they are not effective in the GHz band. In addition, while some elements that aim for noise suppression in the GHz band have been disclosed, they are not as simple or convenient as ferrite beads. Thus, realization of an inductor element with a structure similar to that of ferrite beads which provide a noise suppressing effect in the GHz band is eagerly awaited.

Furthermore, while methods in which ferrite is used in combination with a dielectric body and in which an electric wave absorbing body is employed secondarily have been disclosed, they pose problems such as requiring a grounding electrode and having complicated structures.

SUMMARY OF THE INVENTION

It is an object of the present invention to provide an inductor element for noise suppression which is capable of suppressing the high frequency component in the GHz band through absorption.

It is a further object of the present invention to provide an inductor element for noise suppression that does not require a grounding electrode and can be employed, therefore, in a location where no grounding pattern is provided.

In order to achieve the objects described above, the inductor element for noise suppression according to the present invention is provided with a core through which a signal line conductor passes. The core is at least partially constituted of a compound member composed of ferromagnetic metal particles and resin. The compound member imparts a frequency-dependent absorption loss to a signal running through the signal line conductor. The absorption loss essentially starts in the GHz band with a high level remaining in effect up to at least 20 GHz.

Thus, with the inductor element for noise suppression according to the present invention, the high frequency component in the GHz band can be suppressed through absorption.

The noise suppressing function achieved by the inductor element with a signal line conductor passing through its core may be conceptualized as follows. In addition, the beads inductance element according to the present invention requires only that a signal line conductor pass through its core and does not require a grounding conductor. Because of this, it can be used at a location where no grounding pattern is present.

To present the equivalent circuit of the inductor element with a signal line conductor passing through its core in a simplified manner, it can be shown as a serial circuit constituted with an inductance L and a resistance R, with the impedance Z of the element expressed as $Z=j\omega L+R$.

The resistance R, representing the loss in the core and L representing the inductance are dependent upon frequency, and this dependency, in turn, depends upon the magnetic characteristics of the core material. Generally speaking, the magnetic characteristics of the core material are such that the real number component $\mu r'$ decreases and the imaginary number component $\mu r''$ increases in the complex relative magnetic permeability of the material in the frequency band where magnetic resonance or magnetic relaxation is present. The resistance R, which represents the loss at the core is equivalent to $\mu r''/\mu r'$. The inductance L is in proportion to the real number component $\mu r'$ in the complex relative magnetic permeability.

In a high range absorption type inductor element for noise suppression, the impedance $j\ \omega L$ is small on the low frequency side and there is almost no loss R in the core, resulting in an element resembling a simple electric line. In contrast, in the high frequency band, where the loss exists, the impedance $j\ \mu L$ and the resistance component R increase, converting the R component to Joule heat, so that it functions as an absorbing element.

As explained before, generally speaking, the noise component has a higher frequency than the signal component. Thus, by adjusting the loss band to the noise frequency, it becomes possible to suppress noise. In the case of an inductor element, a more outstanding noise suppressing effect is normally achieved when Z and R are both small on the low frequency side and are both large on the high frequency side.

With the high range absorption type ferrite beads in the prior art, the core is constituted by using ferrite with such characteristics. However, the loss provided by the ferrite, although dependent on its composition, is approximately 2 GHz at the highest. Above this, loss cannot be achieved with the imaginary number component $\omega r''$ of the relative magnetic permeability at 0. Consequently, ferrite is effective when the noise frequency is in the MHz band, but noise suppression becomes difficult when the noise frequency is in or above the GHz band.

In contrast, the compound material constituted of ferromagnetic metal particles and resin according to the present invention demonstrates more pronounced loss in the GHz band and the loss remains in effect at and above 20 GHz. As a result, unlike with the ferrite material, sufficient absorption can be assured in the GHz band.

The ferromagnetic metal particles used in the present invention may include, for instance, iron, cobalt, nickel, rare earth metal, an alloy thereof, a compound substance or a amorphous substance. In particular, it has been confirmed that an outstanding effect is achieved with iron particles.

In addition, while the resin to be used in combination with ferromagnetic metal particles may be of any type, as long as it is malleable and capable of maintaining electrical insulation, it has been confirmed that good characteristics are achieved with phenol or epoxy resin. A similar effect can be expected when using rubber, Teflon® or acrylic. Furthermore, a third substance, for instance, oxide particles or fillers for maintaining the shape may be added.

The particle diameter of the ferromagnetic metal particles should fall within the range of 0.01 $\mu$m to 100 $\mu$m. If the particle diameter of the ferromagnetic particles is smaller than 0.01 $\mu$m, sufficient noise absorption characteristics cannot be achieved. It is also not possible to mix the particles with the resin homogeneously and, therefore, quality consistency of the element cannot be assured. If, in contrast, the particle diameter of the ferromagnetic metal particles is larger than 100 $\mu$m, the surface of the element will be rough and the shape of the inductor element cannot be accurately formed. In addition, the inductor element will become large and awkward to handle. A more desirable range for the particle diameter of the ferromagnetic particles is 0.1 μm to 10 μm.

The content of the ferromagnetic metal particles should fall within a range of 30 vol % to 70 vol %. If the content of the ferromagnetic metal particles is less than 30 vol %, sufficient noise suppressing effect cannot be achieved. If the content of the ferromagnetic metal particles is more than 70 vol %, it becomes difficult to mix them with the resin homogeneously and, at the same time, pronounced degradation of the insulation resistance IR will result. Consequently, the impedance on the low frequency side increases and the impedance on the high frequency side where the absorption range is present becomes insufficient. A more desirable range for the content of the ferromagnetic metal particles is 40 vol % to 63 vol %.

DETAILED DESCRIPTION OF THE PREFERRED EMBODIMENTS

Figure 1:
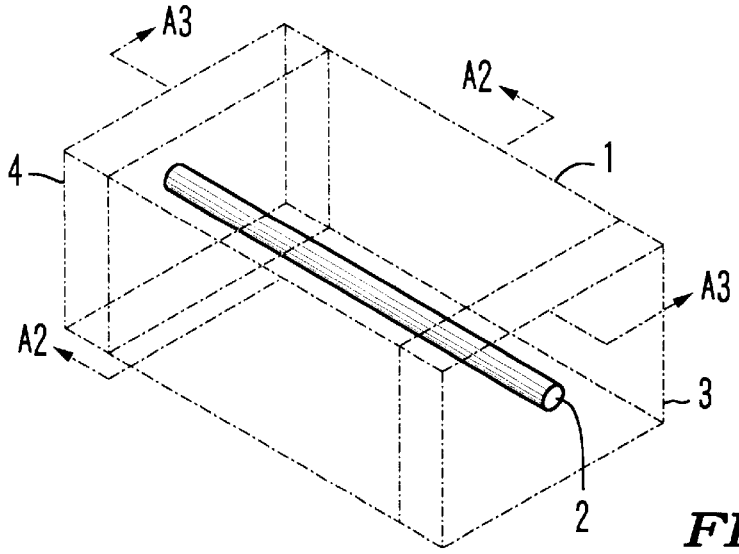
FIG. 1 is a perspective drawing of the inductor element for noise suppression according to the present invention.
Figure 2:
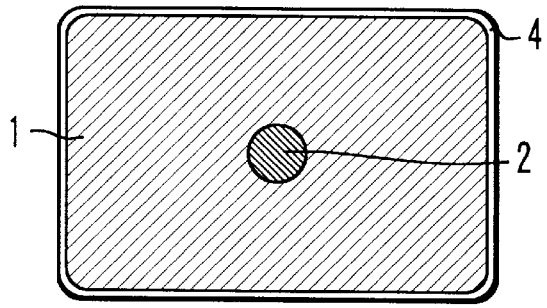
FIG. 2 is a cross section of FIG. 1 through line A2—A2.
Figure 3:
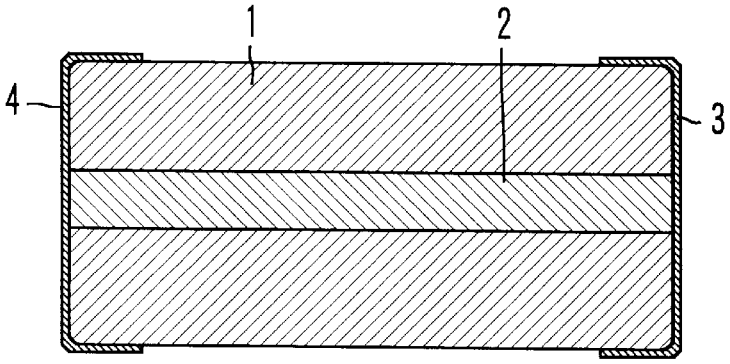
FIG. 3 is a cross section of FIG. 1 through line A3—A3.

As shown in FIGS. 1 to 3, the inductor element for noise suppression according to the present invention is provided with a core 1 through which a signal line conductor 2 passes. The core 1 is at least partially constituted of a compound member composed of ferromagnetic metal particles and resin. This compound member imparts absorption loss in the noise frequency component contained in the signal passing through the signal line conductor 2 at or above GHz.

In the inductor element for noise suppression in this embodiment the entirety of the core 1 is constituted of a compound material composed of ferromagnetic metal particles and resin, as mentioned earlier, and a pair of terminal conductors 3 and 4 and the signal line conductor 2 are also provided.

The pair of terminal conductors 3 and 4 are provided at end surfaces of the core 1 which face opposite each other. The signal line conductor 2 is induced through the core 1 constituted of the compound member, with its two ends connected to the terminal conductors 3 and 4. Next, the method for manufacturing the inductor element shown in FIGS. 1 to 3 is explained.

When the particles are relatively large, several types of commercially available iron particles or atomized particles may be sifted through a mesh to provide a starting material. When the particle size is small, spherical iron particles synthesized from an organometallic compound are used as a starting material. This iron is known as carbonyle iron and, in this experiment, particles with various particle diameters ranging from 0.01 μm and smaller through 100 μm and larger were prepared. As for the resin used in combination with the iron particles, a phenol type resin was used in the embodiment.

A phosphoric acid solution diluted with alcohol and iron particles were mixed in a mortar. The quantity of the phosphoric acid was set so that the weight ratio between the iron and the phosphoric acid would be approximately 1000:5. The phosphoric acid was used in order to prevent degradation of the insulation resistance (IR) by forming a coating on the surface of the iron.

Next, the iron particles with the phosphoric acid coating formed on them were mixed with a resin to prepare a granular substance, and then, through pressing, a rectangular parallelopiped test piece was created with dimensions of approximately 10 mm in depth, 30 mm in width and 5 mm in height. This test piece was soaked with resin and then dried. After this, a suitable heat treatment was performed in order to harden the resin to create the compound material. From this test piece, rectangular parallelepipeds with dimensions of 3.2 mm×1.6 mm×1.6 mm were cut out and in each, a through hole was formed in the lengthwise direction.

A conductive paste was prepared by mixing silver powder to constitute a conductive constituent, and a resin. This paste was injected into the through hole in each test piece to apply the conductive paste onto the internal surface of the through hole, thereby creating a signal line conductor 2. Also, the paste was applied to the two end surfaces of the compound material to form the terminal conductors 3 and 4. After this, a suitable heat treatment was performed to harden the paste which constituted the signal line conductor 2 and the terminal conductors 3 and 4.

In order to evaluate the inductor elements obtained as described above, an impedance analyzer (HP4291A) was employed up to 1 GHz, a network analyzer (HP8720C) and a measuring jig (HP83040) were employed between 1 GHz and 10 GHz. These analyzers were used to measure the impedance Z and the loss R. In addition, up to 1 GHz, the complex magnetic permeability of the compound material was measured with an impedance analyzer (HP4291A) with a toroidal core formed. In the range between 1 GHz and 20 GHz, the toroidal core was inserted in an air line and the jig, and measurement was performed by using software (HP85071A) with a network analyzer (HP8720C). The differences in the frequency ranges for measurement were due to the shape of the test pieces used and the frequency characteristics of the jigs used for measurement.

Figure 4:
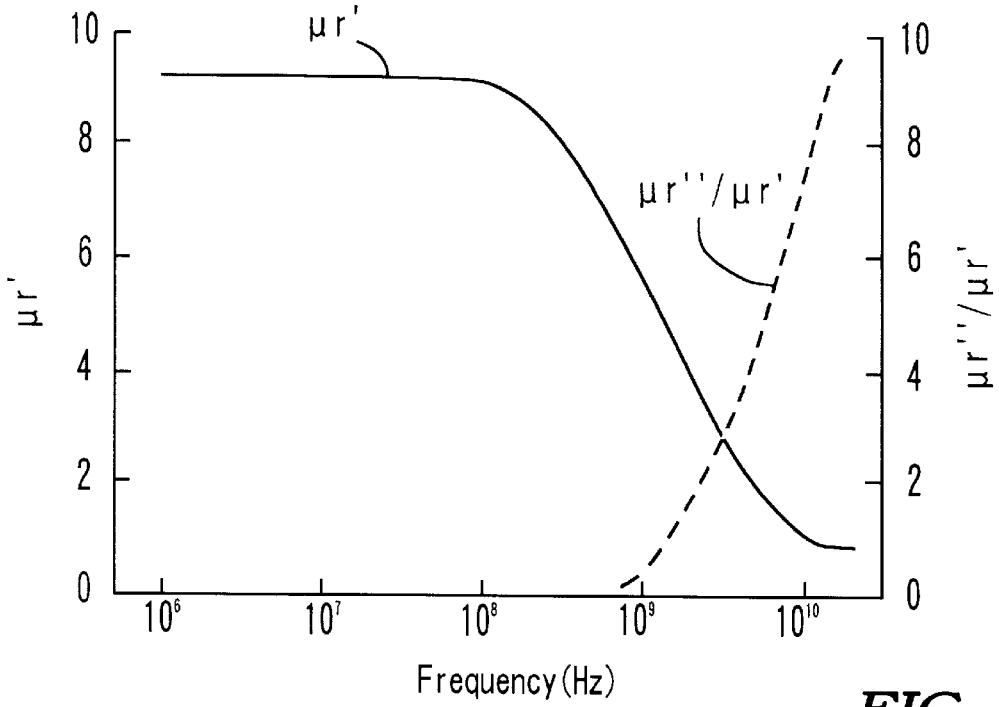
FIG. 4 shows the frequency characteristics of the magnetic permeability and loss in an iron-resin compound material.

FIG. 4 shows the complex magnetic permeability of the iron particle-phenol resin compound material (iron 60 vol %, particle diameter 2 μm). In the figure, the real number component μr' of the complex relative magnetic permeability corresponds to the impedance Z of the element and μr"/μr' corresponds to the loss. The loss increases in the GHz band and this remains effective up to 20 GHz, which is the limit of measurement. The magnetic permeability is reduced as the loss increases.

Figure 5:
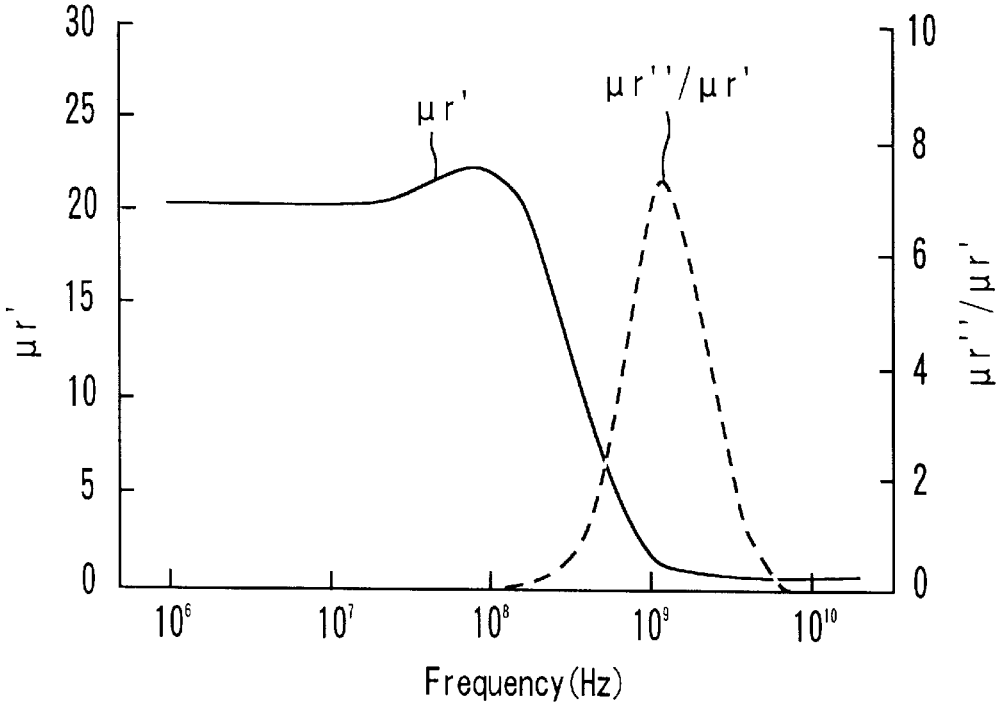
FIG. 5 shows the frequency characteristics of the magnetic permeability and loss in ferrite material.

FIG. 5, which is given for the purpose of comparison, shows the results of similar measurement performed on a test piece with NiZn ferrite. The loss ( μr"/μr') assumes the maximal value at approximately 1 GHz, and is close to 0 in a range higher than 1 GHz. In conformance to this, the magnetic permeability, too, becomes greatly reduced in the GHz band, and approaches 1.

Figure 6:
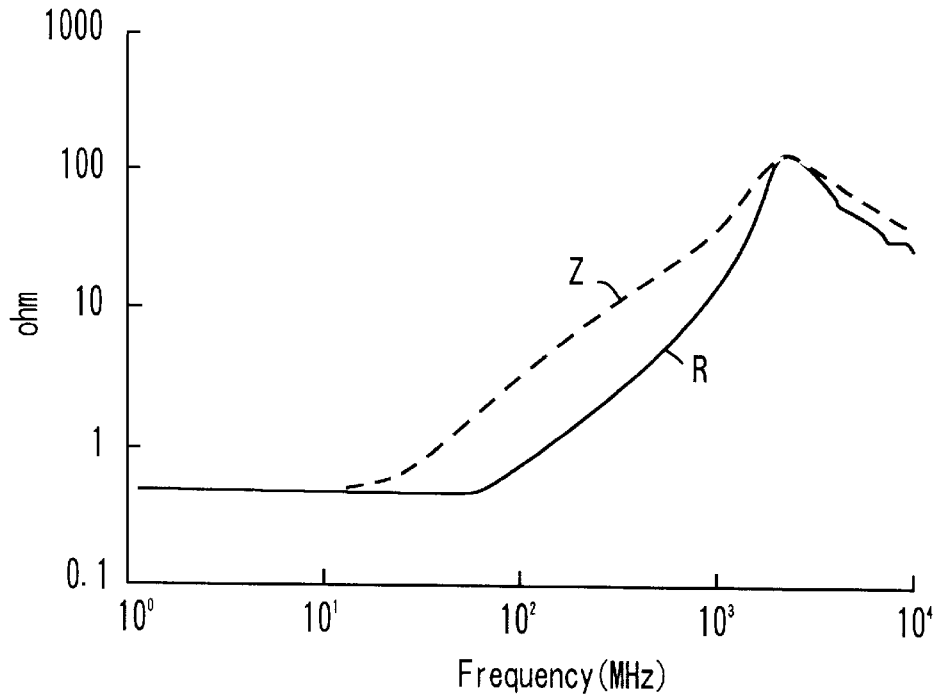
FIG. 6 shows the frequency characteristics of the impedance and the resistance in the inductor element for noise suppression shown in FIGS. 1 to 3.

FIG. 6 shows the frequency characteristics of the impedance Z and the loss R that are observed when the inductor element shown in FIGS. 1 to 3 is prepared using an iron particles-phenol resin compound material (iron 60 vol %, particle diameter 2 μm) for the compound member which constitutes the core 1. The loss becomes more pronounced at approximately 1 GHz and this remains effective up to 10 GHz, which is the upper limit of measurement, demonstrating that the inductor element constitutes a noise suppressing element.

Figure 7:
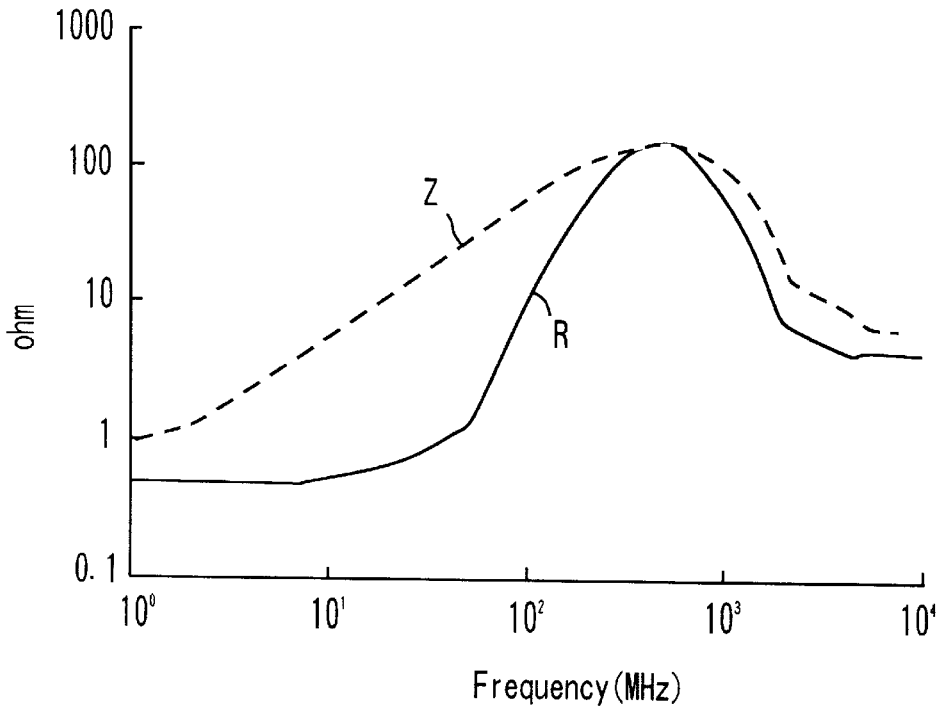
FIG. 7 shows the frequency characteristics of the impedance and the resistance in the inductor element for noise suppression shown in FIGS. 1 to 3 when a ferrite is used as the core material.

FIG. 7 shows the frequency characteristics of the impedance Z and the loss R that are observed when the inductor element shown in FIGS. 1 to 3 is prepared using NiZn ferrite for the core 1. Although the loss R is observed up to approximately 1 GHz, the loss becomes reduced again at higher frequencies, demonstrating that sufficient noise suppression cannot be achieved in the GHz band.

Table 1 shows the results of the characteristics evaluation of the impedance Z and the loss R achieved in elements with varied iron particle diameters and iron content in the core. The evaluation was made for the passing band frequency of 10 MHz and a blocking range frequency of 2 GHz.

TABLE 1

| | Iron particle diameter | Iron content | 10 MHz | | 2 GHz | | |
|---|---|---|---|---|---|---|---|
| No. | average μm | Vol % | Z(Ω) | R(Ω) | Z(Ω) | R(Ω) | |
| 1 | 0.005 | 30 | 0.5 | 0.5 | 50 | 30 | Inconsistent distribution |
| 2 | 0.01 | 40 | 0.5 | 0.5 | 100 | 98 | |
| 3 | 0.1 | 60 | 0.5 | 0.5 | 110 | 99 | |
| 4 | 0.5 | 60 | 0.5 | 0.5 | 110 | 105 | |
| 5 | 1 | 60 | 0.5 | 0.5 | 120 | 120 | |
| 6 | 2 | 60 | 0.5 | 0.5 | 125 | 123 | |
| 8 | 3 | 60 | 0.5 | 0.5 | 128 | 126 | |
| 9 | 5 | 60 | 0.5 | 0.5 | 130 | 130 | |
| 10 | 10 | 60 | 0.5 | 0.5 | 130 | 130 | |
| 11 | 30 | 60 | 0.5 | 0.5 | 108 | 108 | |
| 12 | 80 | 60 | 0.5 | 0.5 | 100 | 90 | |
| 13 | 100 | 60 | 0.5 | 0.5 | 100 | 92 | |
| 14 | 200 | 60 | 0.5 | 0.5 | 100 | 90 | Rough surface |
| 15 | 1 | 10 | 0.5 | 0.5 | 40 | 20 | 2 GHz Z reduced |
| 16 | 1 | 20 | 0.5 | 0.5 | 50 | 35 | 2 GHz Z reduced |
| 17 | 1 | 30 | 0.5 | 0.5 | 100 | 88 | |
| 18 | 1 | 40 | 0.5 | 0.5 | 120 | 118 | |
| 19 | 1 | 50 | 0.5 | 0.5 | 123 | 120 | |
| 20 | 1 | 55 | 0.5 | 0.5 | 125 | 120 | |
| 21 | 1 | 63 | 0.5 | 0.5 | 130 | 125 | |
| 22 | 1 | 65 | 0.8 | 0.8 | 110 | 110 | |
| 23 | 1 | 70 | 0.9 | 0.9 | 110 | 110 | |
| 24 | 1 | 75 | 1.5 | 1.5 | 80 | 80 | IR reduced |
| 25 | 1 | 80 | 2 | 2 | 70 | 70 | IR reduced |
| 26 | 1 | 90 | 3 | 3 | 75 | 75 | Inconsistent distribution |
| 27 | 10 | 10 | 0.5 | 0.5 | 42 | 18 | 2 GHz Z reduced |
| 28 | 10 | 20 | 0.5 | 0.5 | 60 | 55 | 2 GHz Z reduced |
| 29 | 10 | 30 | 0.5 | 0.5 | 100 | 95 | |
| 30 | 10 | 40 | 0.5 | 0.5 | 120 | 110 | |
| 31 | 10 | 50 | 0.5 | 0.5 | 125 | 122 | |
| 32 | 10 | 55 | 0.5 | 0.5 | 130 | 126 | |
| 33 | 10 | 63 | 0.5 | 0.5 | 130 | 127 | |
| 34 | 10 | 65 | 0.6 | 0.6 | 110 | 110 | |
| 35 | 10 | 70 | 0.9 | 0.9 | 100 | 100 | |
| 36 | 10 | 75 | 1.5 | 1.5 | 70 | 70 | IR reduced |
| 37 | 10 | 80 | 3 | 3 | 65 | 65 | IR reduced |
| 38 | 10 | 90 | 4 | 4 | 62 | 62 | IR reduced |

Figure 8:
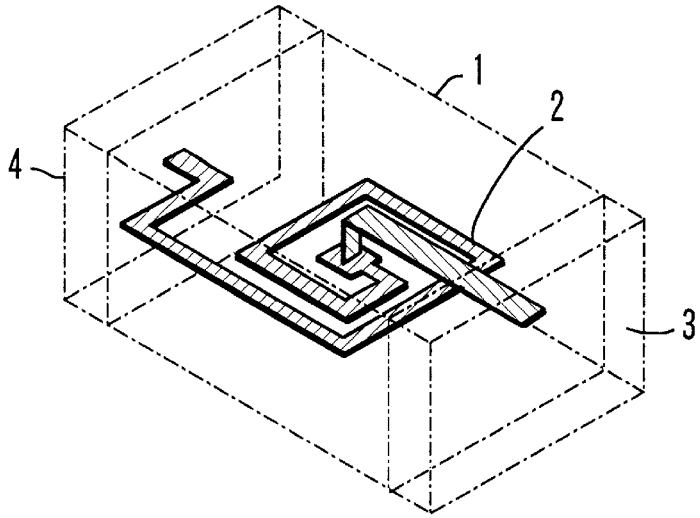
FIG. 8 is a perspective of another embodiment of the inductor element for noise suppression according to the present invention.

FIG. 8 is a perspective drawing showing another embodiment of the inductor element for noise suppression according to the present invention. In this embodiment, the signal line conductor 2 is formed in a spiral shape within the core 1, which is constituted of a compound material prepared by mixing ferromagnetic metal particles and resin. The method for manufacturing the inductor element shown in FIG. 8 is explained below.

Carbonyle iron particles with an average particle diameter of 3 μm were used as a starting material. After the carbonyle iron particles were treated with phosphoric acid, they were mixed with an epoxy resin, a solvent and a curing catalyst to obtain a slurry solution. This solution was applied onto a Mylar film using the doctor blade method to produce a sheet with a thickness of approximately 60 μm.

Paste for electrodes constituted of silver-resin was applied in a spiral shape through screen printing on to this sheet. A through hole was formed in a separate sheet, the paste for electrodes was charged into this through hole and a pattern for drawing out was formed by printing. Thus, a signal line conductor 2 in a spiral shape was created.

The sheet obtained as described above was sandwiched in a plurality of plain sheets and, at approximately 100° C., a pressure of approximately 50 Kgw was applied to it. The block thus obtained was then cut into 3.2 mm×1.6 mm pieces. Paste for electrodes prepared by mixing silver to constitute the conductive component, and resin, which was applied to the two ends of each piece to form terminal electrodes 3 and 4.

A suitable heat treatment was performed on the test pieces to harden the resin. Nickel or tin plating was plated on the surfaces of the terminal electrodes 3 and 4 and, finally, the were washed before use as test pieces.

Figure 9:
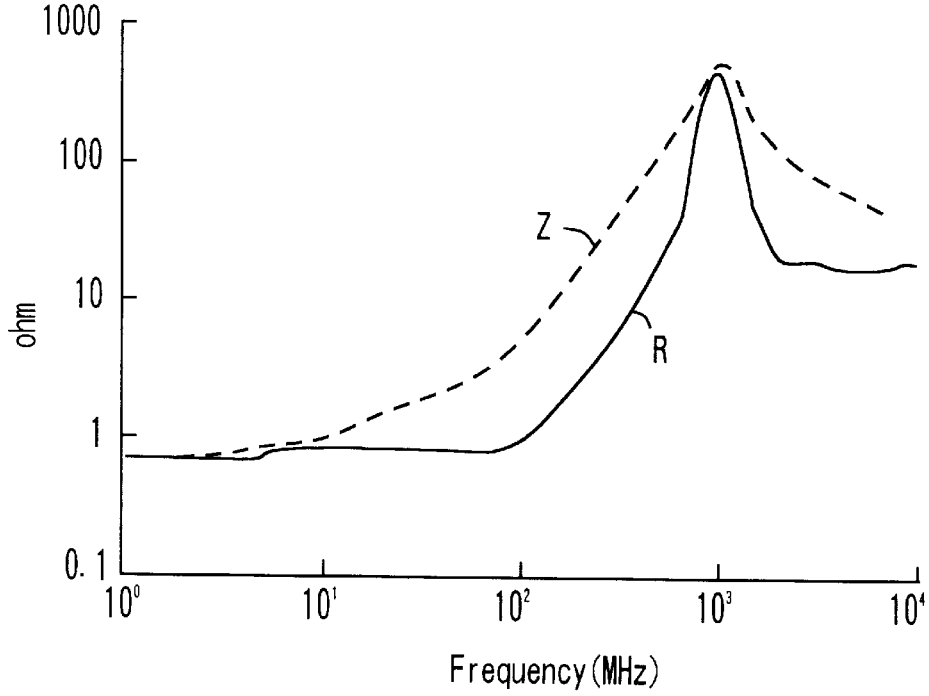
FIG. 9 shows the frequency characteristics of the impedance and the resistance in the inductor element for noise suppression shown in FIG. 8.

FIG. 9 shows the frequency characteristics of the impedance Z and the loss R of the inductor element shown in FIG. 8 obtained through the manufacturing method described above. It is clear that good characteristics are demonstrated with this inductor element.

Figure 10:
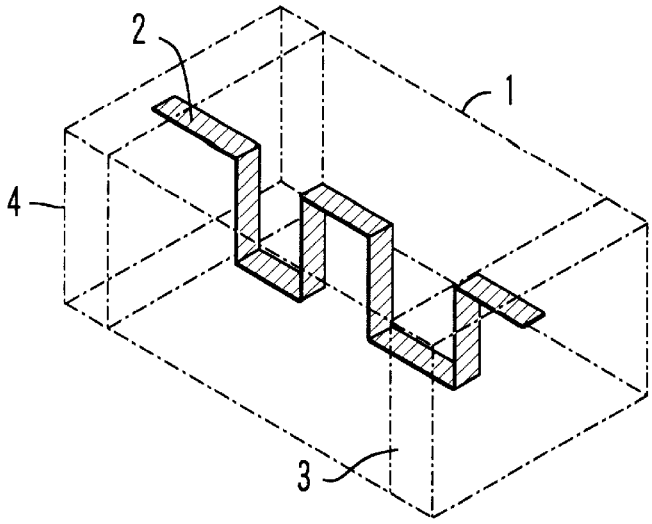
FIG. 10 is a perspective of yet another embodiment of the inductor element for noise suppression according to the present invention.

FIG. 10 is a perspective drawing showing yet another embodiment of the inductor element according to the present invention. In this embodiment, the signal line conductor 2 is formed in a zigzag shape within the core 1 constituted of a compound material prepared by mixing ferromagnetic metal particles and resin. The method for manufacturing the inductor element shown in FIG. 10 is explained below.

Rectangular parallelepipeds with dimensions of 3.2 mm×1.6 mm×1.6 mm were obtained through a method similar to that employed in the first embodiment. For the ferromagnetic metal particles, carbonyle iron particles with a particle diameter of approximately 1 μm were used. In addition, an epoxy resin was used for the resin to be mixed with the ferromagnetic metal particles.

A through hole was formed reaching from one lengthwise surface to the other lengthwise surface of each test piece. A paste constituted of silver and resin was injected into this through hole to form a conductive layer on the internal surface of the through hole. In addition, a pattern for drawing out was formed on the lengthwise surface through screen printing to form a zigzag pattern (meandering line) through this through hole. With this, a signal line conductor 2 with a zigzag pattern was achieved. In addition, the paste was applied to its two end surfaces and a suitable heat treatment was performed to form terminal conductors 3 and 4.

Figure 11:
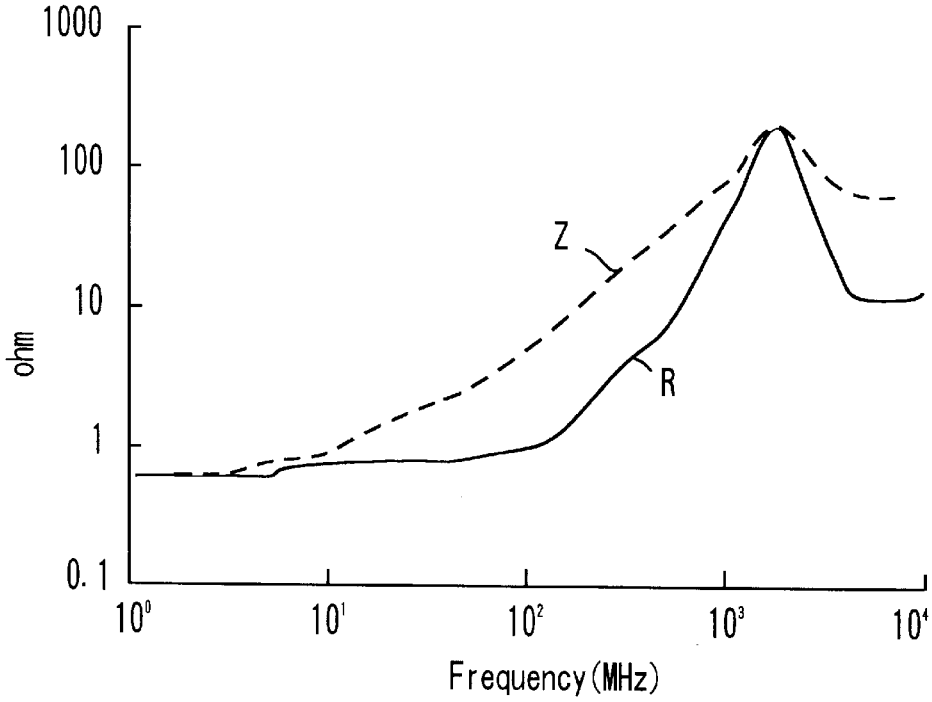
FIG. 11 shows the frequency characteristics of the impedance and the resistance in the inductor element for noise suppression shown in FIG. 10.

FIG. 11 shows the frequency characteristics of the impedance Z and the loss R of the inductor element shown in FIG. 10 obtained through the manufacturing method described above. FIG. 11 shows that the inductor element demonstrates good characteristics.

Figure 12:
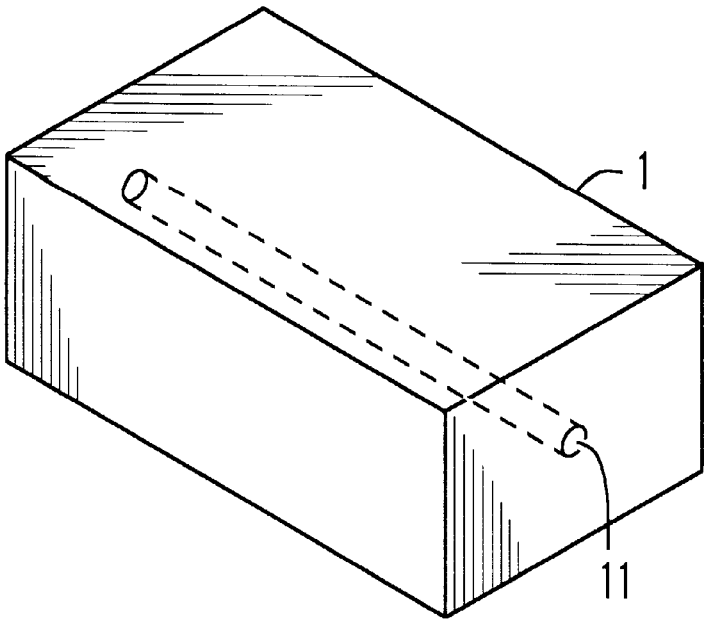
FIG. 12 is a perspective of yet another embodiment of the inductor element for noise suppression according to the present invention.
Figure 13:
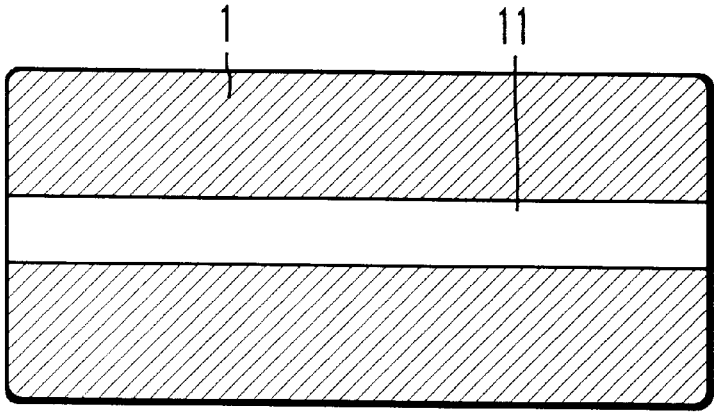
FIG. 13 is a cross section of the inductor element f or noise suppression shown in FIG. 12.

FIG. 12 is a perspective of yet another embodiment of the inductor element for noise suppression according to the present invention and FIG. 13 is a cross section of the inductor element for noise suppression shown in FIG. 12. In this embodiment, a through hole 11 is provided in the compound member which constitutes the core 1 and the external signal line conductor is passed through the through hole 11.

In this case, too, frequency-dependent absorption loss can be imparted to the signal running through the signal line conductor and the absorption loss essentially starts in the GHz band with a high level of absorption remaining in effect up to at least 20 GHz.

While the invention has been particularly shown and described with reference to preferred embodiments thereof, another means for manufacturing the inductor element according to the present invention may include the steps of coating one surface of the supporting body with a paste constituted of ferromagnetic particles and resin so as to form a sheet on which a conductive line is formed by printing a conductive paste. The surface including the conductive line then being coated again with a paste constituted of ferromagnetic particles and resin so as to cover the conductive line, after which a suitable heat treatment under pressure is applied.

Alternatively, a metal wire which lends itself to be formed in a suitable shape may be used instead of a conductive paste to form the conductive line included in the signal line conductor of the present invention.

What is claimed is:

1. A noise suppression device, comprising:

an inductor circuit element including a core comprising, at least in part, a compound member with a mixture of resin and ferromagnetic metal particles having a phosphoric acid adhesion;

two terminal conductors provided on opposite ends of said core, with at least one end of each of said terminal conductors provided on another surface of said core; and a signal line conductor passing through said core, with each end of said signal line conductor connected to one of said terminal conductors, wherein:

said ferromagnetic metal particles include iron particles having diameters that fall within a range of 0.0 μm to 10 μm, and a content of said ferromagnetic metal particles is within a range of 30 vol % to 70 vol %.

2. The noise suppression device of claim 1, wherein:

said signal line conductor is a metal wire or a compound member with a mixture of silver and polymer.

3. The noise suppression device of claim 1, wherein:

said terminal conductors are compound members with a mixture of silver and polymer.

4. The noise suppression device of claim 1, wherein:

said signal line conductor comprises a spiral shape within said core.

5. The noise suppression device of claim 1, wherein:

said inductor circuit element comprises a rectangular parallelepiped shape within said core.

6. The noise suppression device of claim 1, wherein:

said signal line conductor comprises a rectangular zigzag shape within said core.

7. The noise suppression device of claim 1, wherein:

a weight ratio between said ferromagnetic metal particles and said phosphoric acid is approximately 1000:5.

8. The noise suppression device of claim 1, wherein:

magnetic permeability of said core, at a frequency of 1000 MHz or more, is within a range of 2 to 10.

9. The noise suppression device of claim 1, wherein:

a surface of each of said terminal conductors is plated.

10. The noise suppression device of claim 4, wherein:

said surface of each said terminal conductors is plated with nickel or tin.

11. The noise suppression device of claim 1, wherein said ferromagnetic metal particles include iron particles having diameters that fall within a range of 1.0 μm and 10.0 μm.

12. The noise suppression device of claim 1, wherein the content of said ferromagnetic particles is within a range of 40 vol % to 63 vol %.

13. The noise suppression device of claim 1, wherein said ferromagnetic metal particles comprise carbonyle iron particles having a spherical shape.

* * * * *